US010309118B2

(12) United States Patent
Distinti

(10) Patent No.: US 10,309,118 B2
(45) Date of Patent: Jun. 4, 2019

(54) APPARATUS FOR GENERATING WAVES IN A SWIMMING POOL

(71) Applicant: John Distinti, San Jose, CA (US)

(72) Inventor: John Distinti, San Jose, CA (US)

( * ) Notice: Subject to any disclaimer, the term of this patent is extended or adjusted under 35 U.S.C. 154(b) by 4 days.

(21) Appl. No.: 14/455,813

(22) Filed: Aug. 8, 2014

(65) Prior Publication Data

US 2015/0040306 A1 Feb. 12, 2015

Related U.S. Application Data

(60) Provisional application No. 61/864,630, filed on Aug. 11, 2013.

(51) Int. Cl.
*E04H 4/00* (2006.01)

(52) U.S. Cl.
CPC ..... *E04H 4/0006* (2013.01)

(58) Field of Classification Search
CPC .... E04H 4/006; A63B 69/0093; A63B 69/125
See application file for complete search history.

(56) References Cited

U.S. PATENT DOCUMENTS 4,303,520 A * 12/1981 Wirt ..... E02B 15/10 210/242.1
5,320,449 A * 6/1994 Demarteau ..... E04H 4/0006 4/491

* cited by examiner

*Primary Examiner* — Janie M Loeppke

(57) ABSTRACT

A wave-making apparatus for use in a swimming pool comprises a motor that may be powered at least in part by the flow of water from a swimming pool pump. When water from the pump flows through an inlet in the motor housing, it rotates a turbine within the housing, which in turn rotates a cantilever arm about a central axis of the turbine. A distal end of the cantilever arm is attached, e.g., by a tether or other device, to a buoy or float at the surface of the water such that rotation of the cantilever arm pulls the float down periodically, creating perpetual swimming pool waves.

7 Claims, 4 Drawing Sheets

APPARATUS FOR GENERATING WAVES IN A SWIMMING POOL

CROSS REFERENCE TO RELATED APPLICATIONS

This application claims priority under 35 U.S.C. § 119 to U.S. Provisional Application Ser. No. 61/864,630 filed on Aug. 11, 2013, which application is incorporated by reference herein in its entirety.

TECHNICAL FIELD

This invention relates to recreational apparatus for use in a swimming pool, and in particular to devices and methods of generating waves in a swimming pool.

BACKGROUND

Unless otherwise indicated herein, the elements described in this section are not prior art to the claims and are not admitted to be prior art by inclusion in this section.

At the present known methods and devices for the production of waves in swimming pools involve substantial cost and specialized construction of wave generation systems integrated into a swimming pool. For example, pneumatically operated wave generating systems utilize large caissons that are cyclically placed under a changing air pressure by means of blowers, so that the water level in the individual caissons is caused to oscillate out-of-phase. These caissons and their blowers are housed adjacent a swimming pool, requiring a separate structure and cost to build and operate. Other mechanical or pneumatic systems use pistons or mechanical impellers to drive large amounts of water into a pool, and require special built-in space or wave chamber. Other known wave-making machines are driven by electric motor acting through connecting rod and crank and gear reduction mechanism, driving large quantities of water through a pool to generate waves. All of these known installations are large, heavy, and/or costly to construct, purchase and operate.

Thus, there remains a need for a simple, cost-effective system and method that is adaptable for use in any swimming pool to generate waves and provide family entertainment.

SUMMARY

In an example embodiment, an apparatus for generating waves in a swimming pool (also referred to herein as an "Aqua-Wave" device) includes a motor, a buoy (also referred to herein as a "float"), and an anchor. One or more cantilever arms, or crank arms, are attached to motor at a central axle, or crankshaft. The cantilever arm is configured and dimensioned to rotate a crankshaft in a substantially circular path when a turbine within the motor housing is rotated. A distal end of the cantilever arm is configured and dimensioned to attached to the buoy, for example by a rope or tether. The buoy is preferably buoyant and the buoy and tether are dimensioned such that, when the apparatus is placed in a swimming pool, the buoy floats at or near the surface of the pool. The motor may be secured to a weight or anchor, for example by an anchor line, where the anchor is of sufficient weight to overcome the buoyancy of the buoy or float. In other embodiments, the motor may be secured to the bottom and/or side of the pool by other means.

In one aspect, an apparatus for generating waves includes a turbine motor that is configured to submerged in a swimming pool and driven by the flow of water through the motor housing. The turbine may be disposed within the motor housing, and may have vanes or blades extending from the body of the turbine, such that flow of water through the housing forces against the blades and rotates the turbine, which in turn rotates the cantilever arm(s) and pulls the float or buoy down in a periodic or cyclical fashion. In some embodiments, the housing comprises an inlet that is adapted to connect to a hose or other device that directs flow of water from the pump of a swimming pool through the housing to drive the turbine. An outlet on the housing allows the water to flow out of the housing after passing through a channel housing the blades of the turbine.

In one aspect, the buoy or float is configured and dimensioned to optimize the size and/or shape of waves generated by the apparatus. In other aspects, a plurality of attachment points on the float may be used to produce asymmetrical movement of the float to optimize wave size or other characteristics. In other embodiments, the float may be configured and dimensioned to support the weight of one or more individuals. In such embodiments, the motor may be used to move or rock the float, for example to increase the enjoyment and difficulty of one or more users to stand, sit, lay or climb on float. In such embodiments, the float may be a raft, a surfboard, a floating climbing rock or wall, a slide, or other buoyant device to climb or play on within a swimming pool.

In some embodiments, an apparatus for generating waves includes a motor having a cantilever arm rotatable about a central axis of the motor, and a substantially buoyant float configured to attach to the cantilever arm, such that rotation of the cantilever arm periodically pulls the float downward when the motor is submerged in a swimming pool and the float is tethered to the cantilever arm. Such an apparatus may further include an anchor configured and dimensioned to sit on the bottom of the swimming pool and connect by an anchor line to the motor.

In another aspect, the motor may comprise a housing having an inlet and an outlet and a turbine disposed within the housing. The turbine may include a body and a plurality of blades extending from the body, and the cantilever arm may be connected to the turbine such that rotation of the turbine rotates the cantilever arm about the central axis of the motor.

In another aspect, the blades of the turbine extend into a channel within the housing, the channel is fluidly connected with the inlet of the housing, and the inlet is adapted to connect to a pool pump to direct water flowing from the pump through the channel to rotate the turbine. In another aspect, the apparatus may include an auxiliary inlet in fluid communication with the channel, wherein the auxiliary inlet is adapted to connect with a water, air, or pressure source to flow water (or air, or to apply pressure to and) through the channel of the housing to rotate the turbine.

These as well as other aspects and advantages will become apparent to those of ordinary skill in the art by reading the following detailed description, with reference where appropriate to the accompanying drawings. Further, it should be understood that the embodiments described in this overview and elsewhere are intended to be examples only and do not necessarily limit the scope of the invention.

BRIEF DESCRIPTION OF THE DRAWINGS

Example embodiments are described herein with reference to the drawings.

Like reference numerals refer to the same or similar components throughout the several views of the drawings.

DETAILED DESCRIPTION

Described herein are apparatus and methods for generating waves in a swimming pool or other body of water. In the following description, for purposes of explanation, numerous examples and specific details are set forth in order to provide a thorough understanding of the present invention. It will be evident, however, to one skilled in the art that the present invention may include some or all of the features in these examples alone or in combination with other features described below, and may further include modifications and equivalents of the features and concepts described herein.

Figure 1:
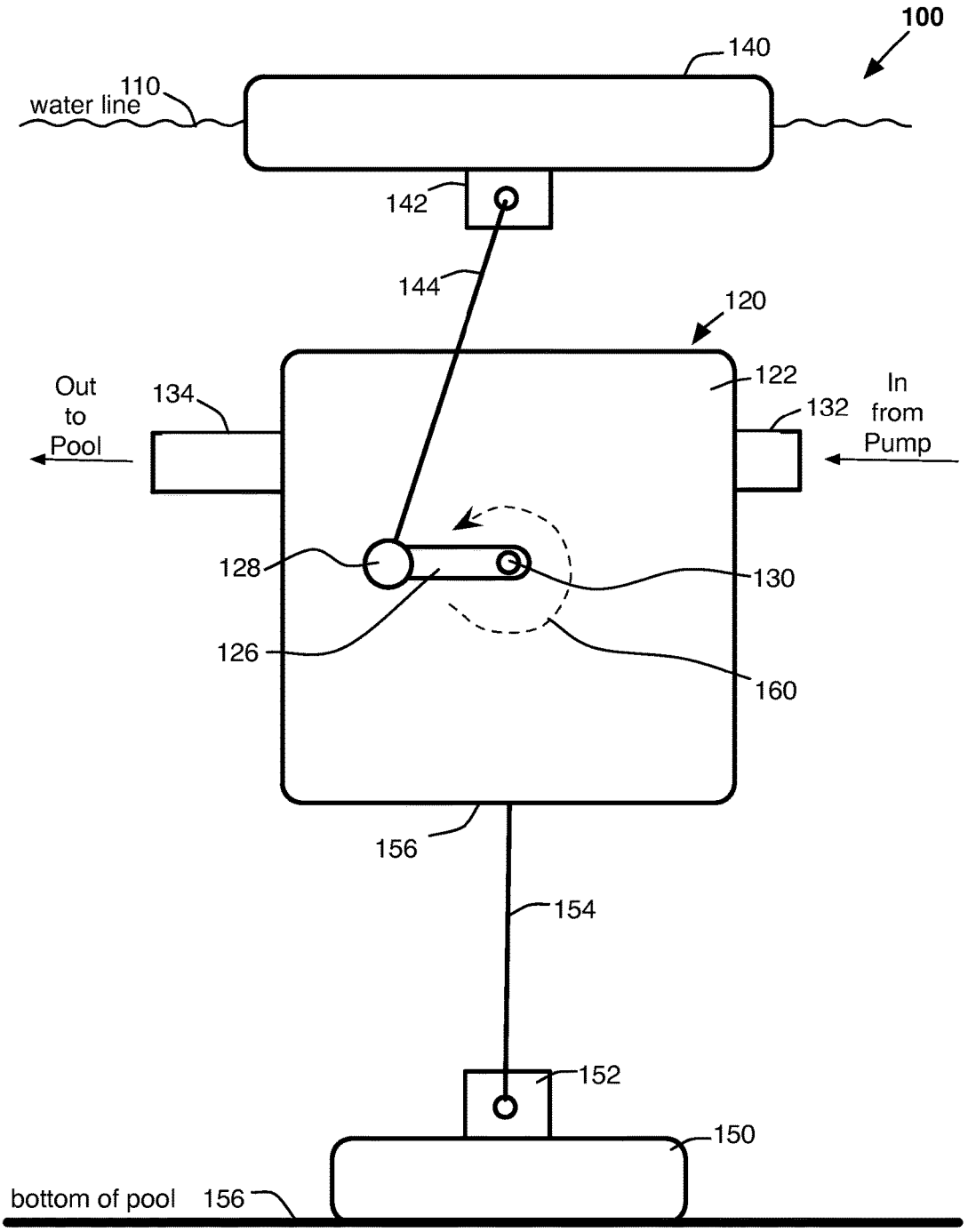
FIG. 1 is a schematic side view of an apparatus for generating waves in a swimming pool in accordance with one or more example embodiments.

Referring to FIG. 1, an example embodiment of an apparatus 100 for generating waves in a swimming pool (also referred to herein as an "Aqua-Wave" device) includes a motor 120, a buoy 140 (also referred to herein as a "float"), and an anchor 150. One or more cantilever arms 126 are attached to motor 130 at a central axle or crankshaft 130. Arm 126 is configured and dimensioned to rotate at crankshaft 130, e.g., in a substantially circular path as shown by dashed line 160. Distal end 128 of cantilever arm 126 is configured and dimensioned to attached to buoy 140, e.g. at an attachment eye or of buoy 140, by a tether 144. Buoy 140 is preferably buoyant and dimensioned such that, when apparatus 100 is placed in a swimming pool, buoy 140 floats at the surface of the pool 110. Housing 122 is configured to attach to a weight or anchor 150, e.g., by an anchor line 154 attached to a bottom end 156 of housing 122. Anchor 150 may include an attachment point, eye, or other member 152 to facilitate attachment of anchor line.

In an example of use of apparatus 100 in a swimming pool, anchor 150 is placed on the bottom of the pool 156 and attached by anchor line 154 to bottom end 156 of housing as shown in FIG. 1. Buoy 140 is attached to end 128 of cantilever arm 126 by tether 144 and floats substantially at the pool water surface 110, such that motor 120 is suspended between anchor 150 and buoy 140. Rotation of cantilever arm 128 through its circular path 160 pulls the tethered buoy downward periodically, e.g., each time the distal end 128 of cantilever arm moves downward through its arc the buoy 140 is pulled down, and as the distal end 128 moves past the lowest point of the circular path 160 and moves upward, the float 140 moves upward due to its buoyancy in water. This repeated and substantially up and down movement creates waves on the surface 110 of the swimming pool.

Figure 3:
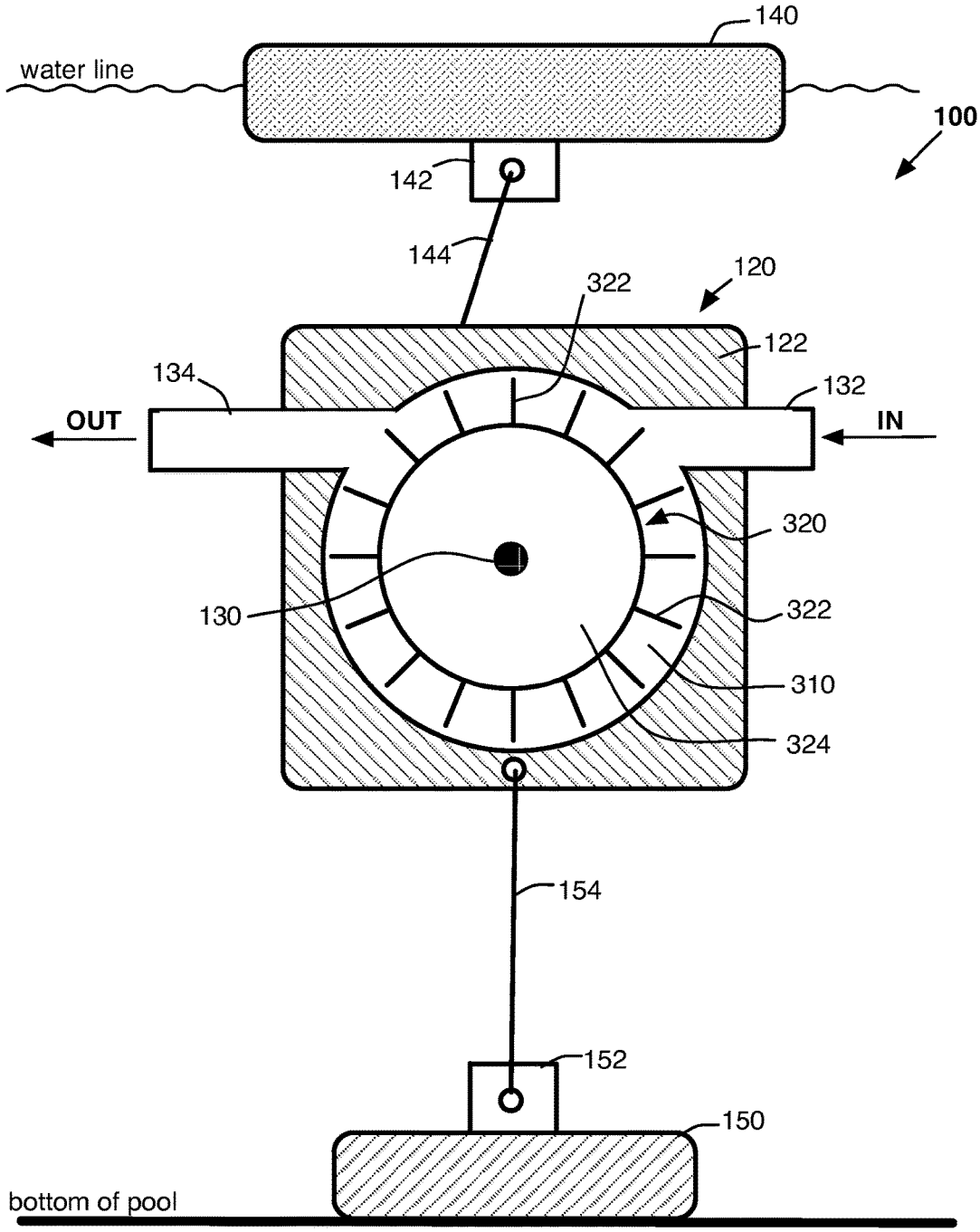
FIG. 3 is a cross-sectional view of the apparatus of FIG. 1 in accordance with one or more example embodiments.
Figure 4:
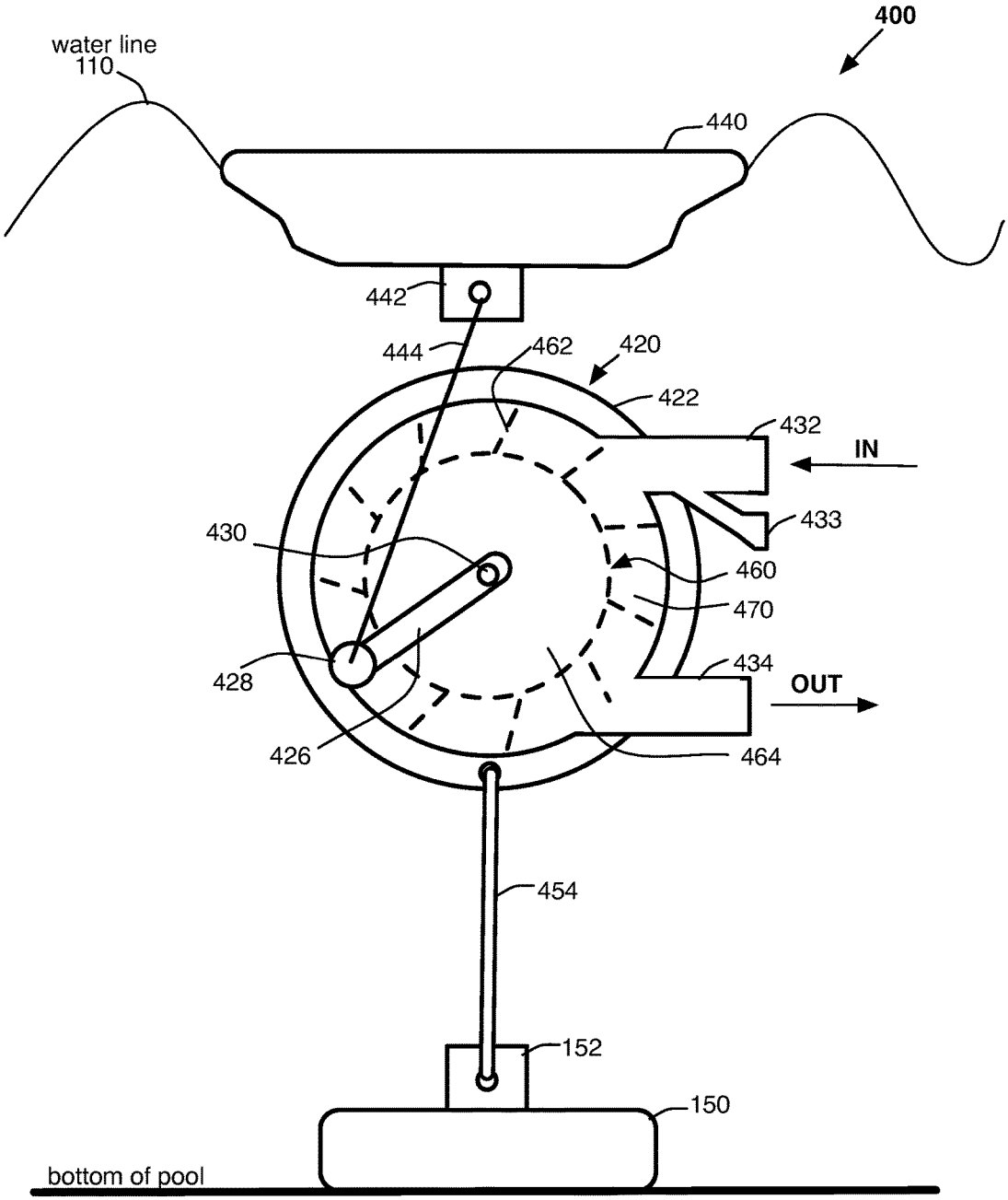
FIG. 4 is a schematic side view of another embodiment of an apparatus for generating waves in a swimming pool.

In some embodiments, motor 120 may be a substantially mechanical motor configured to be driven by the flow of water directed through the housing 122 of motor 120. Motor 102 may include an intake 132 configured and dimensioned to attach, e.g., using a hose or other fitting, to an outlet of a swimming pool pump such that water from the pump flows through intake 132 and into housing 122. An outlet 134, which in some embodiments is disposed on an opposite side of housing 122 from intake 132, allows water (and/or air, in some embodiments) that enters from intake 132 to exit the housing 122. In some embodiments, intake 132 and outlet 134 are on a same side of housing 122 (e.g., depending upon the configuration of turbine 320, 460 and flow channel 310, 470 as shown in FIGS. 3 and 4). In one aspect, a substantially water and/or airtight seal is used between intake 132 and a hose or other tubing that feeds water or air into housing 122 to drive motor 120 (e.g., to turn cantilever arm 128). In other embodiments, a negative pressure may be connected to outlet 134 of the housing, e.g., to pull water through the housing to drive, or aid in driving, the turbine 320.

In some embodiments, housing 122 may be buoyant. For example, housing 122 may be constructed in whole or in part using a buoyant material, or one or more floats or other buoyant members may be attached to housing 122. In some embodiments, anchor line may be a rope or flexible line. In other embodiments it may be a substantially rigid member to help support or stabilize motor 120 during movement of the cantilever arm 126 and tethered float 140. In other embodiments, motor 120 or housing 122 may be secured to the bottom 156 and/or a wall of a swimming pool instead of or in addition to using an anchor 150. In some embodiments, motor 120 is of sufficient weight to rest on the bottom of the pool 156 such that an anchor 150 or anchor line 154 is not necessary to counteract the buoyancy of float 140.

Figure 2:
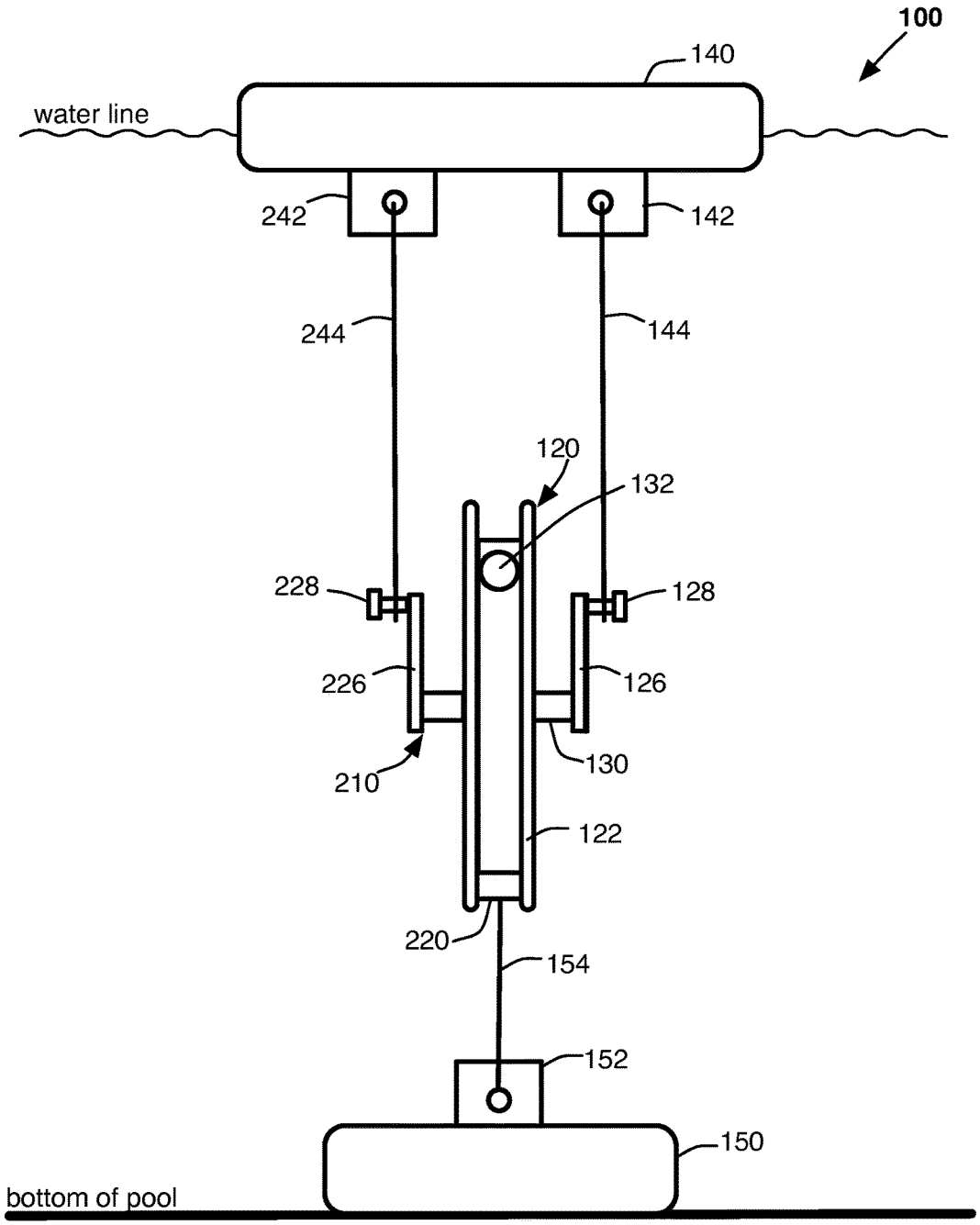
FIG. 2 is a schematic end view of a the apparatus of FIG. 1 in accordance with one or more example embodiments.

Referring to FIG. 2, an end view of an example apparatus 100 described above may include a crank assembly 210 having two cantilever arms 126, 226, each with a distal end 128, 228 configured to attached to float 140 via a pair of tethers 144, 244 or other attachment means. Proximal end of cantilever arms 126, 226 of assembly 210 are joined by a crankshaft 130 that, when rotated by motor (e.g., driven by turbine assembly as shown and described below with respect to FIG. 3), cantilever arms 126, 226 rotate and displace float 140 as described above with respect to FIG. 1. Tethers 144, 244 may be attached to float 140 at one or more attachment points, e.g., at attachment members 142, 242. In some embodiments, a single attachment point may be used. In some embodiments, attachment points 142, 242 are positioned substantially symmetrically with respect to each other on the float 140 as shown (and substantially centrally located from a front view perspective as shown in FIG. 1), such that float is pulled down in a substantially vertical path as cantilever assembly 210 rotates. A lower attachment point 220 on housing 122 may be used to facilitate attachment of anchor line 154.

In some embodiments embodiments, aspects of apparatus may be configured and dimensioned to pull or move float in a canting, tilting, or asymmetrical matter, e.g., to produce waves of optimal or desired quality. For example, attachment points on float 140 may be positioned off-center, such that pulling on tether 144 and/or 244 causes a canting or tilting of float 140 with respect to the surface of the water. In some embodiments, tethers 144, 244 may be of substantially different lengths or comprise materials of different rigidity or elasticity. In some embodiments, cantilever arms 126, 226 may be of substantially different lengths. In other embodiments, one tether, e.g., tether 144, may be used to fix an end of float 140 to housing 122, anchor 150 or a side of the pool, e.g., such that one portion of the float or buoy remains substantially fixed, while the other side (e.g., attached to tether 244 and cantilever arm 226) moves as described above—thereby creating a canted or hinged action of movement of the float 140 when arm 226 is rotated. In some embodiments, one or more floats 140 may be used, and/or float 140 may be configured and dimensioned to facilitate a desired shape, size or pattern of waves (see, e.g., float 440 of FIG. 4). In some alternative embodiments, assembly 210 is configured and dimensioned by one skilled in the art to move distal ends 128, 228 up and down, as opposed to a circular path of cantilever arms 126, 226. These and other variations or modifications may be made without departing from the scope and spirit of the invention.

Turning now to FIG. 3 a cross-sectional view of apparatus 100 in accordance with one or more example embodiments is shown. In this example, an Aqua-Wave apparatus 100 is configured substantially as shown in FIG. 1, including motor 120, float 140 and weight 150. Housing 122 of motor 120 is configured to attach to float 140, e.g., by one or more tethers 144 and to anchor 150 by one or more anchor lines 154. One or more attachment members 142 and 152 may be used and positioned as desired to facilitate attachment to float 140 and anchor 150, respectively.

Motor 120 shown in FIG. 3 includes a turbine 320 positioned centrally within housing 122. Turbine 320 includes a number of vanes or blades 322 extending from the substantially circular body 324 of turbine 320. Blades 322 extend into a substantially circular channel 310 formed between the body 324 of turbine and housing 122 (or one or more other structures within housing 122 may be used to form a portion of channel 310). Crankshaft 130 passes through and is attached to turbine 320 at the center of turbine 320, such that rotation of turbine about its central axis rotates the turbine. Channel is open to inlet 132 and outlet 134, such that water (or, in some embodiments, air) flowing into inlet pushes against blades 322 to rotate turbine 320. Such rotation of turbine causes rotation of crankshaft 130 (and in turn, cantilever arms 126, 226 of FIGS. 1 and 2), and cyclically displaces float 140 up and down to generate waves in the pool. As mentioned earlier, housing 122 and/or components of turbine may be constructed of any desired materials, e.g., plastic or other polymers, metal, alloys, foam, or any other suitable materials. In alternative embodiments, turbine and/or crank assembly 210 of motor 120 may be battery operated or solar operated, and/or may driven in whole or in part by other mechanical, hydraulic or electromechanical means.

FIG. 4 is a schematic side view of another embodiment of an apparatus 400 for generating waves in a swimming pool. This embodiment is similar in many aspects to apparatus 100, e.g., having a motor 420 that is configured and dimensioned to cause cyclical displacement of a buoy, or float 440, to generate waves. Motor 420 may include a substantially circular housing 422, containing a substantially circular turbine (shown in dashed lines as turbine 460, having body 464 and blades 462) configured to rotate within the housing about a central axis 430. A channel 470 within housing is fluidly connected with an inlet 432 and an outlet 434, which may be disposed on the same side of housing 422 as shown, on opposite sides, or in other locations as desired. Inlet 432 is configured to connect and seal with a hose or other device to direct water (or in some embodiments, air) into channel 470 around turbine 460. Some embodiments may include an auxiliary inlet 433, which may be used, for example, to connect a water hose, air hose or other device to replace or augment the flow of water through inlet 432, e.g., in increase the rotational force and/or speed of turbine 460. One or more outlets 434 may be employed, and the diameter of inlets 432, 433 and outlet 434 and channel 470 may be varied to optimize the volume and speed of water (and/or air in some embodiments) through channel 470.

In some embodiments, vanes or blades 462 may be angled with respect to turbine body 464, e.g., as shown in FIG. 4, to vary or optimize the force with which water, air or other fluid drives turbine 460. In some embodiments, blades 462 are substantially rigid to optimize transfer of hydraulic force to rotation of the turbine 460. In some embodiments blades 462 may be adjustable and/or removable. Rotation of the turbine 470 causes rotation of one or more cantilever arms 426, as discussed above with respect to FIGS. 1-3. A distal end 428 of cantilever arm 426 is configured to attach, e.g., by a tether 444, to float 440, e.g., at a desired attachment point or member 442.

An anchor line 454 may be used to fix a bottom portion of housing 422 with an anchor 150 (e.g., at an anchor attachment point 152). In some embodiments, anchor line is a substantially rigid member 454 to help fix the position of motor 420 with respect to the anchor. In some embodiments, alternative or supplemental anchor points may be used to secure the position of motor 120. The length of tether 444 is preferably longer than the distance from distal end 428 of cantilever arm 426 and the top of housing 422 when distal end is at its lowest point in its circular path about the housing (e.g., to avoid contact between the float 440 and the motor 420 when the float 440 is pulled to its lowest point).

In some embodiments, float 440 may be configured and dimensioned to optimize buoyancy or the shape and/or size of waves generated in the water 110 by the float 440 as the float is 440 is displaced alternately by the force of the motor 420 pulling the float 440 downward (e.g., during a downward cycle of the cantilever arm 426) and the buoyancy of the float 440 moving it upward (e.g., during an upward cycle of the cantilever arm 426). For example, float 440 may be configured to include angled or concave edges to produce waves of desired characteristics, or float may be dimensioned (e.g., thicker) or composed of desired materials to increase or decrease buoyancy. In some embodiments, tether 444 may be a rope or line of substantial tensile strength to counteract the buoyancy of float 440. In other embodiments, tether 444 may be at least partially elastic or substantially rigid, as desired, to optimize movement of the float with respect to the motor.

In other embodiments, float 140, 440 of FIGS. 1-4 may be configured and dimensioned to support the weight of one or more individuals. In such embodiments, motor 420 may be used to move float 140, 440, e.g., to increase the enjoyment and difficulty of one or more users to stand, sit, lay or climb on float. In some embodiments, the float may be a raft, a surfboard, a climbing "rock", wall, slide, or other buoyant device to climb or play on within a swimming pool.

The foregoing description illustrates various embodiments of the present invention along with examples of how aspects of the present invention may be implemented. The above examples and embodiments should not be deemed to be the only embodiments, and are presented to illustrate the flexibility and advantages of the present invention. Based on the above disclosure and the following claims, other arrangements, embodiments, implementations and equivalents will be evident to those skilled in the art and may be employed without departing from the spirit and scope of the invention.

What is claimed is:

1. An apparatus for generating waves, comprising:

a motor comprising a housing having an inlet adapted to receive a flow of fluid from a fluid source, a turbine disposed within the housing and rotatable about a central axis, said turbine having a body and a plurality of blades extending from the turbine body, a channel for directing the flow of fluid through said motor, said channel formed between the housing and the turbine body and in fluid communication with the inlet, wherein the plurality of blades extend from the turbine body into the channel, and a first cantilever arm extending from a first side of the housing and rotatable about the central axis;

a substantially buoyant float configured to attach to the first cantilever arm, said float including a first attachment member; and a first tether for attaching the first attachment member to the first cantilever arm.

2. The apparatus of claim 1, further comprising an anchor line having a first end for attaching to and securing said motor in a submerged position within a swimming pool.

3. The apparatus of claim 2, further comprising an anchor to which a second end of the anchor line attaches to secure the motor in the submerged position.

4. The apparatus of claim 1, wherein the fluid is water and the fluid source is selected from the group consisting of a swimming pool pump and a garden hose.

5. The apparatus of claim 4, further comprising an auxiliary inlet in fluid communication with the channel, said auxiliary inlet adapted to connect with a second water source to flow water from the second water source through the channel of the housing to rotate the turbine.

6. The apparatus of claim 1, wherein:

said motor further comprises a second cantilever arm extending from a second side of the housing opposite the first side, said float includes a second attachment member, and said apparatus further comprises a second tether for attaching the second cantilever arm to the second attachment member.

7. The apparatus of claim 1, wherein the substantially buoyant float is any of a buoy, a raft, a surfboard, a climbing rock, a wall, a slide, or a play structure.

* * * * *